United States Patent [19]

Höffgen

[11] Patent Number: 4,560,149

[45] Date of Patent: Dec. 24, 1985

[54] GAS BUBBLE BRICK FOR METALLURGICAL VESSELS

[76] Inventor: Hans Höffgen, Im Silbertal 13, 5410 Höhr-Grenzhausen, Fed. Rep. of Germany

[21] Appl. No.: 664,439

[22] Filed: Oct. 24, 1984

[30] Foreign Application Priority Data

Nov. 17, 1983 [DE] Fed. Rep. of Germany ..... 3341491

[51] Int. Cl.[4] ..... C21C 5/48

[52] U.S. Cl. ..... 266/220; 266/265

[58] Field of Search ..... 266/220, 265, 266, 270

[56] References Cited

FOREIGN PATENT DOCUMENTS 849446 8/1970 Canada ..... 266/220

105868 4/1982 European Pat. Off. ..... 266/220

*Primary Examiner*—L. Dewayne Rutledge

*Assistant Examiner*—Robert L. McDowell

*Attorney, Agent, or Firm*—Browdy and Neimark

[57] ABSTRACT

A gas bubble brick for metallurgical vessels consists of a gas-permeable shaped brick (2) which can be installed in the wall or the bottom of the vessel and having directed porosity, which is designed in a ring region (6) of the shaped brick, a gas-tight metal encasing (3) partially surrounding the shaped brick (2) and welded together from a metal jacket (8) extending around the lateral circumferential area of the shaped brick and a metal cover (9) covering the outer face of the shaped brick, as well as a gas supply pipe (4), which is welded onto the rim of a central gas inlet orifice (11) of the metal cover. In order to achieve that the ring region (6) with directed porosity is optimally utilized for gas passage, an annular collecting chamber (16) is provided in front of the inlet cross-section of this region (6), the connecting area of the gas supply pipe (4) being joined to the annular collecting chamber (16) via at least one joining channel (17). Preferably, several spiral-armed joining channels (17), arranged at regular intervals around the circumference, are provided so that a circulating flow is generated in the annular collecting chamber (16), ensuring even pressure conditions.

7 Claims, 2 Drawing Figures

GAS BUBBLE BRICK FOR METALLURGICAL VESSELS

Figure 1:
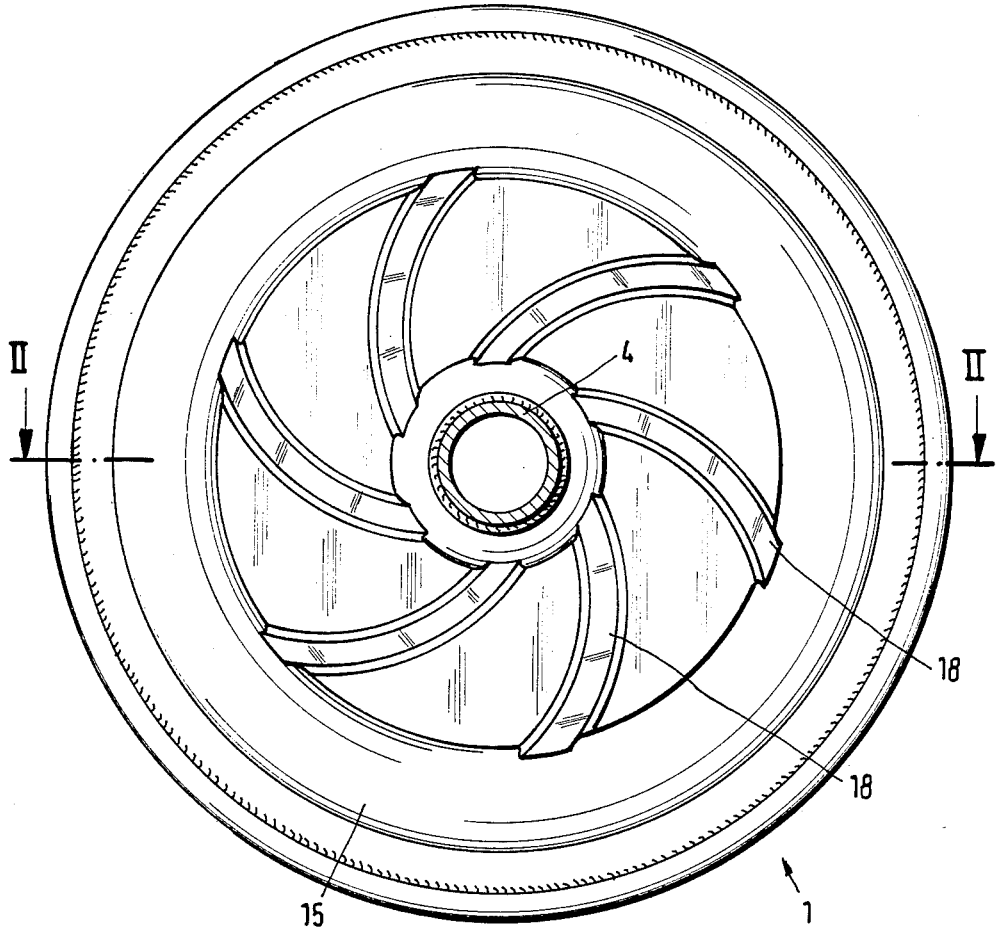

The invention relates to a gas bubble brick for metallurgical vessels, consisting of a gas-permeable shaped brick which can be installed in the wall or the bottom of the vessel and having directed porosity, which is designed in a ring region of the shaped brick, a gas-tight metal encasing partially surrounding the shaped brick and welded together from a metal jacket extending around the lateral circumferential area of the shaped brick and a metal cover covering the outer face of the shaped brick, as well as a gas supply pipe, which is welded onto the rim of a central gas inlet orifice of the metal cover.

In the case of gas bubble bricks with directed porosity, not only is the porosity inherent in the material of the shaped brick utilised for passage of the gas, but there are also additional thin bores in the bubble brick, through which the gas can pass. In the case of gas bubble bricks of truncated cone design, the bores are preferably arranged in a concentric ring region of the brick.

In the case of the known gas bubble bricks of the type stated, there is the problem that the individual bores of the ring region are unevenly impinged so that there can be no optimum utilization of the bubble brick.

The invention is based on the object of further developing a gas bubble brick of the type mentioned at the start in such a way that the ring region provided with directed porosity in particular is optimally utilised for gas passage.

According to the invention, this object is achieved by providing an annular collecting chamber in front of the inlet cross-section of the region having directed porosity and by joining the connecting area of the gas supply pipe to the annular collecting chamber via at least one joining channel.

By the construction according to the invention, it is accomplished that an even pressure distribution is produced ahead of all bores of the ring region, so that an even through-flow of the bubble brick is achieved due to the uniform pressure conditions.

Preferably, the joining channel enters the annular collecting chamber at an oblique angle. This tangential flow component causes a rotating gas flow to be generated in the annular collecting chamber, which further accelerates the production of even pressure distribution.

For an optimum flow guidance configuration, it is expedient to design the joining channel in the shape of a spiral.

Depending on the size of the brick, preferably several joining channels are arranged at regular intervals around the circumference, all joining channels entering the collecting chamber obliquely at the same angle.

The gas inlet orifice can be surrounded by a circular inlet chamber, the joining channels extending from the inlet chamber to the annular collecting chamber. Due to the extended inlet chamber, an even impingement of all joining channels distributed around the circumference is achieved.

The annular collecting chamber, the inlet chamber and the joining channels are preferably formed by bead-shaped bulges in the metal cover. This structural measure makes it very easy to produce all cavities and channels. They can be formed in the cover of the metal encasing in a single operation. Furthermore, this yields the advantage for the metal cover that its rigidity is considerably increased, so that it does not suffer any undesired deformation even when subjected to high purge gas pressures. It is thus ensured that flow guidance always proceeds evenly and optimally.

Figure 2:
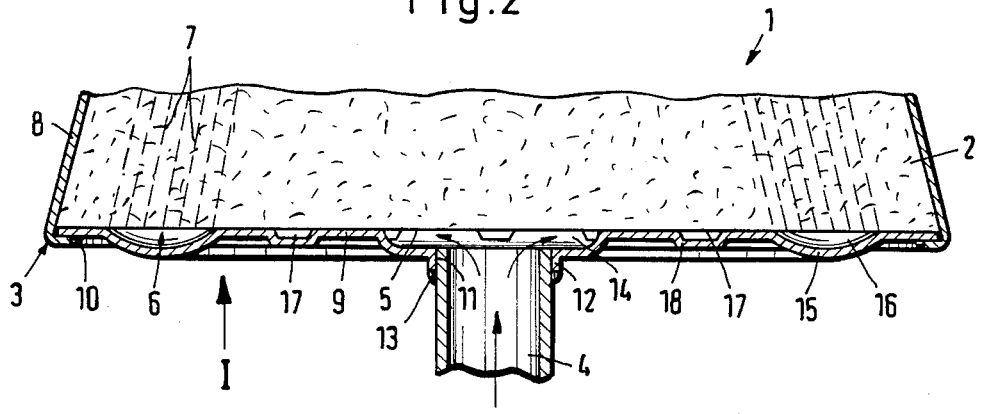

An example of the invention is illustrated in the drawing and is described in detail below with reference to the drawing, in which FIG. 1 shows a view of a gas bubble brick in the direction of arrow I in FIG. 2 and FIG. 2 shows a section along the line II—II in FIG. 1.

According to the drawing, the gas bubble brick 1 principally consists of a shaped brick 2 made of porous, refractory material, a metal encasing 3, which partially surrounds the shaped brick 2, and a gas supply pipe 4.

The shaped brick 2 is designed in the shape of a truncated cone, the larger face 5 of the shaped brick 2, which in the installed state of the gas bubble brick is directed towards the outside of the metallurgical vessel, being the inlet side for the purge gas.

In a concentric ring region 6 of the shaped brick 2, a directed porosity consisting of a plurality of bores 7 of very small diameter is designed. The bores 7 of which only the centre lines are indicated in the drawing, extend from the outer face 5 to the inner face of the shaped brick 2, which inner face comes into contact with the melt in the installed state.

Around its circumferential area, the shaped brick 2 is surrounded by a metal jacket 8, whereas the outer face 5 of the shaped brick is covered by a metal cover 9. The metal cover 9 rests against the outer face 5 of the shaped brick 2 and extends to the outermost edge of the face 5. In this outer region, the edge of the metal jacket 8 is flanged around the metal cover 9 to which it is joined gas-tight by means of a welding seam 10 running round.

In its centre, the metal cover 9 has a gas inlet orifice 11, which bears a cylindrical rim protruding in the axial direction. The gas supply pipe 4 is connected gas-tight to the gas inlet orifice 11, the end of the gas supply pipe 4 being fitted positively in the gas inlet orifice 11 and joined gas-tight on the outside to the rim 12 by means of a welding seam 13 running round.

Directly adjoining the gas inlet orifice 11 is a circular inlet chamber 14, which is shaped into the metal cover 9 by punching. Also worked into the metal cover is a bead-shaped bulge 15 running round and creating between the face 5 of the shaped brick 2 and the cover material a collecting chamber 16 which runs directly in front of the inlet cross-section of the ring region 6 having directed porosity.

The inlet chamber 14 and the collecting chamber 16 are joined to each other by six spiral-armed joining channels 17. In the same way as the inlet chamber 14 and the collecting chamber 16, the joining channels 17 are formed by bead-shaped bulges 18. The six spiral-armed joining channels 17 are arranged at regular intervals around the circumference and follow the same directional sense.

The metal cover 9 can be produced with all its bead-shaped bulges in a single operation. As a result of the beads, the metal cover 9 is given very good stability and can therefore withstand considerable pressures without deforming. Nor does any warping of the cover occur when the welding seams 10 and 13 are made.

The purge gas reaching the inlet chamber 14 through the gas supply pipe 4 is distributed evenly into the six joining channels 17 and passes from there into the collecting chamber 16. Since the purge gas flows with a strong tangential component obliquely into the collecting chamber 16, a circulating gas flow is generated in the collecting chamber, so that an even pressure distribution is achieved in front of the entire inlet cross-section of the ring region 6 having directed porosity. This ensures that there is an even flow over the circumference of the gas bubble brick.

Whereas the inlet chamber 14 and the gas collecting chamber 16 are about two to three millimeters high, the joining channels 17 are only about one to two millimeters high. The width of the joining channels 17 is about five to six millimeters. This dimensioning means that a relatively high flow rate of the purge gas is achieved in the joining channels, which contributes to good gas distribution with even pressure conditions being achieved in the collecting chamber 16.

In the case of another embodiment, not shown in the drawing, the inlet chamber surrounding the gas inlet orifice, the annular collecting chamber and the channels joining the two chambers are formed by recesses in the outer face of the shaped brick. In the case of this exemplary embodiment, the metal cover can be designed completely flat.

I claim:

1. Gas bubble brick for metallurgical vessels consisting of a gas-permeable shaped brick which can be installed in the wall or the bottom of the vessel and having directed porosity, which is designed in a ring region of the shaped brick, a gas-tight metal casing partially surrounding the shaped brick and welded together from a metal jacket extending around the lateral circumferential area of the shaped brick and a metal cover covering the outer face of the shaped brick, as well as a gas supply pipe, which is welded onto the rim of a central gas inlet orifice of the metal cover, characterised in that an annular collecting chamber (16) is provided in front of the inlet cross-section of the region (6) having directed porosity, and in that the connecting area of the gas supply pipe (4) is joined to the annular collecting chamber (16) via at least one joining channel (17).

2. Gas bubble brick according to claim 1, characterised in that the joining channel (17) enters the annular collecting chamber (16) at an oblique angle.

3. Gas bubble brick according to claim 2, characterised in that the joining channel (17) is designed in the shape of a spiral.

4. Gas bubble brick according to claim 1, characterised in that several joining channels (17), arranged at regular intervals around the circumference, are provided and enter the annular collecting chamber (16) obliquely at the same angle.

5. Gas bubble brick according to claim 1, characterised in that the gas inlet orifice (11) of the metal cover (9) is surrounded by a circular inlet chamber (14) and in that the joining channels (17) extend from the inlet chamber (14) to the annular collecting chamber (16).

6. Gas bubble brick according to claim 5, characterised in that the annular collecting chamber (16), the inlet chamber (14) and the joining channels (17) are formed by bead-shaped bulges in the metal cover (9).

7. Gas bubble brick for metallurgical vessels comprising a gas-permeable shaped brick having directed porosity from a first surface to a second surface and a lateral circumferential surface, a gas-tight metal sheath partially surrounding the shaped brick and extending around the lateral circumferential surface of the shaped brick and being connected to a metal cover covering the first surface of the shaped brick with a gas infeed space therebetween, gas supplying means for providing gas to the gas infeed space, said metal cover being provided with an annular collecting chamber for gas fed from the gas supplying means, and at least one joining channel extending from the gas infeed space to the annular collecting chamber.

* * * * *